US009788584B2

(12) United States Patent
Koo

(10) Patent No.: US 9,788,584 B2
(45) Date of Patent: Oct. 17, 2017

(54) GARMENT CONVERTIBLE TO BAG

(71) Applicant: Helen Koo, Auburn, AL (US)

(72) Inventor: Helen Koo, Auburn, AL (US)

( * ) Notice: Subject to any disclaimer, the term of this patent is extended or adjusted under 35 U.S.C. 154(b) by 913 days.

(21) Appl. No.: 14/067,649

(22) Filed: Oct. 30, 2013

(65) Prior Publication Data

US 2014/0137308 A1 May 22, 2014

Related U.S. Application Data

(60) Provisional application No. 61/727,975, filed on Nov. 19, 2012.

(51) Int. Cl.
*A41D 15/04* (2006.01)
*A45F 4/12* (2006.01)

(52) U.S. Cl.
CPC ..... *A41D 15/04* (2013.01); *A45F 4/12* (2013.01); *A41D 2200/20* (2013.01)

(58) Field of Classification Search
CPC ..... A41D 15/04; A41D 2200/20; A41D 2400/422; A45F 4/12
See application file for complete search history.

(56) References Cited

U.S. PATENT DOCUMENTS 4,475,251 A 10/1984 Hopkins
4,563,776 A * 1/1986 Boesen ..... A41D 15/04 2/85
4,689,831 A 9/1987 Greenberger et al.
4,862,520 A * 9/1989 Gazzola ..... A45F 4/12 2/69
5,150,478 A 9/1992 Niedajkasza et al.
5,410,758 A * 5/1995 Dupont ..... A41D 13/1209 2/247
5,724,672 A 3/1998 Chen
5,894,600 A 4/1999 Chenefront
5,996,121 A * 12/1999 Harris ..... A41D 15/04 2/108
6,275,993 B1 * 8/2001 McCarley ..... A41D 15/04 2/209.11
6,578,204 B2 6/2003 Ozenkoski
6,845,518 B1 * 1/2005 Boesen ..... A41D 3/04 2/86
7,165,271 B2 1/2007 Elen
7,891,032 B1 2/2011 Ryan
8,104,099 B2 1/2012 Olmos Plaza
2008/0235849 A1 10/2008 McCray-Clark et al.
(Continued)

OTHER PUBLICATIONS

Helen Koo, Auburn University Technology Disclosure.

*Primary Examiner* — Shaun R Hurley
*Assistant Examiner* — Andrew W Sutton
(74) *Attorney, Agent, or Firm* — Novick, Kim & Lee, PLLC; Sang Ho Lee

(57) ABSTRACT

A garment convertible to a bag is provided. A garment convertible to a bag includes a base member, a first sleeve member extending from the base member, a second sleeve member extending from the base member, and at least one body member extending from the base member. At least one of the base member, the first sleeve member, the second sleeve member, and the at least one body member is configured to be attachably and detachably coupled to at least another of the base member, the first sleeve member, the second sleeve member, and the at least one body member so as to define the bag.

16 Claims, 20 Drawing Sheets

(56) References Cited

U.S. PATENT DOCUMENTS

| | | | | |
|---|---|---|---|---|
| 2010/0111448 | A1 | 5/2010 | Li | |
| 2010/0122395 | A1* | 5/2010 | Wall | A41D 15/04 2/84 |
| 2011/0206299 | A1* | 8/2011 | Carmody | A41D 3/04 383/4 |
| 2012/0005801 | A1* | 1/2012 | Parr | A41D 3/08 2/84 |
| 2012/0276802 | A1* | 11/2012 | Anderman | A63H 3/003 446/27 |
| 2013/0239290 | A1* | 9/2013 | Rossi | A41D 7/008 2/84 |
| 2015/0096097 | A1* | 4/2015 | Soon-Osberger | A41D 1/205 2/69 |
| 2015/0121604 | A1* | 5/2015 | Lee | A41D 11/00 2/84 |
| 2015/0143602 | A1* | 5/2015 | Sparks | A41D 15/04 2/69.5 |
| 2015/0196077 | A1* | 7/2015 | McIntire, Jr. | A41D 15/04 2/2.5 |
| 2015/0320125 | A1* | 11/2015 | Opperman | A63H 3/003 446/28 |
| 2016/0157535 | A1* | 6/2016 | Tirro | A41D 15/04 2/93 |

* cited by examiner

12

13

GARMENT CONVERTIBLE TO BAG

FIELD OF THE INVENTION

This invention relates generally to a garment convertible to a bag.

BACKGROUND OF THE INVENTION

Garments and bags are essential items that people wear and carry. A garment may include textile materials and improve the comfort of the wearer. It can shield against hot or cold conditions and serve as a barrier keeping infectious and toxic materials away from the wearer's body. It protects the wearer from dangerous elements and thus enhances safety during the conduct of the wearer's activities. Bags are commonly used by people to transport personal items from place to place. People use a bag to store various articles when they go out or travel. Generally, bags are used for storing items. However, at some point if the user has nothing to store in the bag, carrying the empty bag could be troublesome.

In this regard, if a garment can be converted to a bag, or vice versa, it could solve the problem and be useful for its user. For example, if the user encounters an unexpected event, such as weather changes during the traveling, the user might need extra clothing. If the user can convert the bag to a garment and wears the same, the user can solve the problem. Furthermore, in doing so, during the traveling, the user can decrease the volume of baggages by brining a single item that can be convertible to either a bag or a garment.

Likewise, if the temperature rises, the user may desire to take off the garment worn. In that case, the user needs a spare hand for carrying the garment. If the user can convert the user's garment to a bag and wear the same, it would be convenient for the user. Therefore, it is demanded that a garment be convertible to a bag and vice versa.

SUMMARY OF THE INVENTION

In view of the aforementioned problems, the present disclosure provides a garment convertible to a bag.

In one example of the apparatus for a garment convertible to a bag includes a base member, a first sleeve member extending from the base member, a second sleeve member extending from the base member, and at least one body member extending from the base member. At least one of the base member, the first sleeve member, the second sleeve member, and the at least one body member may be configured to be attachably and detachably coupled to at least another of the base member, the first sleeve member, the second sleeve member, and the at least one body member to define the bag.

For example, the body member may be configured to be attachably and detachably coupled to at least one of the first sleeve member, the second sleeve member, and the base member. The first sleeve member may be configured to be attachably and detachably coupled to at least one of the base member, and the body member. The second sleeve member may be configured to be attachably and detachably coupled to at least one of the base member and the body member.

Each and every of the base member, the first sleeve member, the second sleeve member, and the at least one body member may include a pair of sides and an opening.

The base member may include a pair of base sides, a base opening, and a base coupling member on the periphery of the base member. The first sleeve member may include a pair of first sleeve sides, a first sleeve opening, and a first sleeve coupling member on the periphery of the first sleeve. Likewise, the second sleeve member may include a pair of second sleeve sides, a second sleeve opening, and a second sleeve coupling member on the periphery of the second sleeve. The at least one body member may include a pair of body sides, a body opening, and at least one body coupling member on the periphery of the body member.

The at least one body coupling member may include a first body coupling member, a second body coupling member, and a third body coupling member. The first body coupling member may be configured to be attachably and detachably coupled to the base coupling member. The second body coupling member may be configured to be attachably and detachably coupled to the first sleeve coupling member. The third body coupling member may be configured to be attachably and detachably coupled to the second sleeve coupling member.

The base opening may be defined between the pair of base sides. The first sleeve opening may be defined between the pair of first sleeve sides. The second sleeve opening may be defined between the pair of second sleeve sides. The body opening may be defined between the pair of body sides.

The first sleeve member and the second sleeve member may have a substantially same shape to each other. For example, the first sleeve member and the second sleeve member have a polygonal or circular shape. At least one of the first sleeve member, the second sleeve member, the base member, and the at least one body member may have for example at least one of shapes of triangle, quadrilateral, pentagon, hexagon, octagon, cross, trapezoid, circle, and semi-circle. The base member may have a polygonal or circular shape. The garment may further include a fabric member symmetrically or asymmetrically attached to at least one of the first sleeve member, the second sleeve member, the base member, and the at least one body member to be a part of the garment.

The first sleeve and the second sleeve may be symmetrically or asymmetrically located with respect to the base member. At least one of the base coupling member, the first sleeve coupling member, the second coupling member, and at least one body coupling member may include at least one of a zipper, a button, a velcro tape, a magnet, a hook, and snap fasteners.

The base member, the first sleeve member, the second sleeve member, and the at least one body member may define at least one of a pyramid shape, cone shape, and cuboid shape.

The at least one body member may include a hood member comprising, a pair of hood sides, a hood opening, and a hood coupling member on the periphery of the hood member, the hood coupling member is configured to be attachably and detachably coupled to at least one of the first sleeve member, the second sleeve member, and the body member. The base member, the first sleeve member, the second sleeve member, the at least one body member, and the hood member are attachably and detachably coupled to one another and define the bag.

The at least one body member may a hood member and a first body member, the hood member includes a pair of hood sides, a hood opening, and a hood coupling member on the periphery of the hood member, and the hood coupling member is configured to be attachably and detachably coupled to at least one of the first sleeve member, the second sleeve member, and the first body member. The base member, the first sleeve member, the second sleeve member, the first body member, and the hood member are attachably and detachably coupled to one another so as to define the bag. The first sleeve member, the second sleeve member, and the at least one body member have a triangular shape.

The garment may further include at least one strap member. The at least one strap member may include a hand strap, a first shoulder strap, and a second shoulder strap.

The base member, the first sleeve member, the second sleeve member, and the body member may define a closed space. The bag may be a backpack or a tote bag. The garment may be made of synthetic fibers.

DETAILED DESCRIPTION OF THE EMBODIMENT

Figure 1:
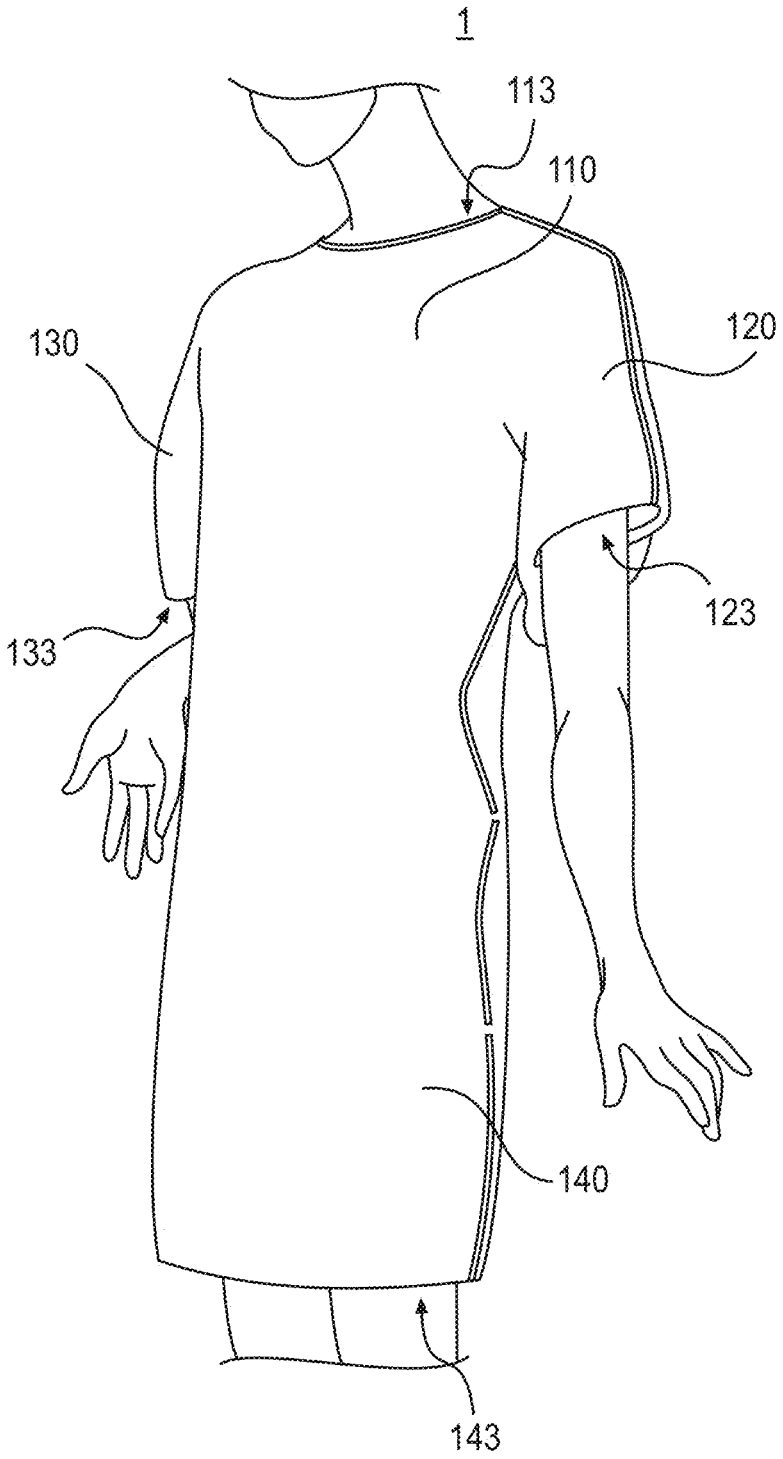
FIG. 1 is a perspective view of a garment worn by a mannequin in an unfolded configuration, taken from front and on the right side according to one embodiment of a present embodiment.

Reference will now be made in detail to embodiments, examples of which are illustrated in the accompanying drawings, wherein like reference numerals refer to the like elements throughout the several views. In this regard, the present embodiments may have different forms and should not be construed as being limited to the descriptions set forth herein. Accordingly, the embodiments are merely described below, by referring to the figures, to explain aspects of the present description. Terms used herein are for descriptive purposes only and are not intended to limit the scope of the disclosure. The terms "comprises" and/or "comprising" are used to specify the presence of stated elements, steps, operations, and/or components, but do not preclude the presence or addition of one or more other elements, steps, operations, and/or components. The terms "first", "second," and the like may be used to describe various elements, but do not limit the elements. Such terms are only used to distinguish one element from another. These and/or other aspects become apparent and are more readily appreciated by those of ordinary skill in the art from the following description of embodiments of the present disclosure, taken in conjunction with the accompanying drawings. The figures depict embodiments of the present disclosure for purposes of illustration only. One skilled in the art will readily recognize from the following description that alternative embodiments of the structures and methods illustrated herein may be employed without departing from the principles of the disclosure described herein. While the invention has been described in terms of several embodiments, those of ordinary skill in the art will recognize that the invention is not limited to the embodiments described, but can be practiced with modification and alteration within the spirit and scope of the appended claims. The description is thus to be regarded as illustrative instead of limiting. There are numerous other variations to different aspects of the invention described above, which in the interest of conciseness have not been provided in detail. Accordingly, other embodiments are within the scope of the claims.

Figure 2:
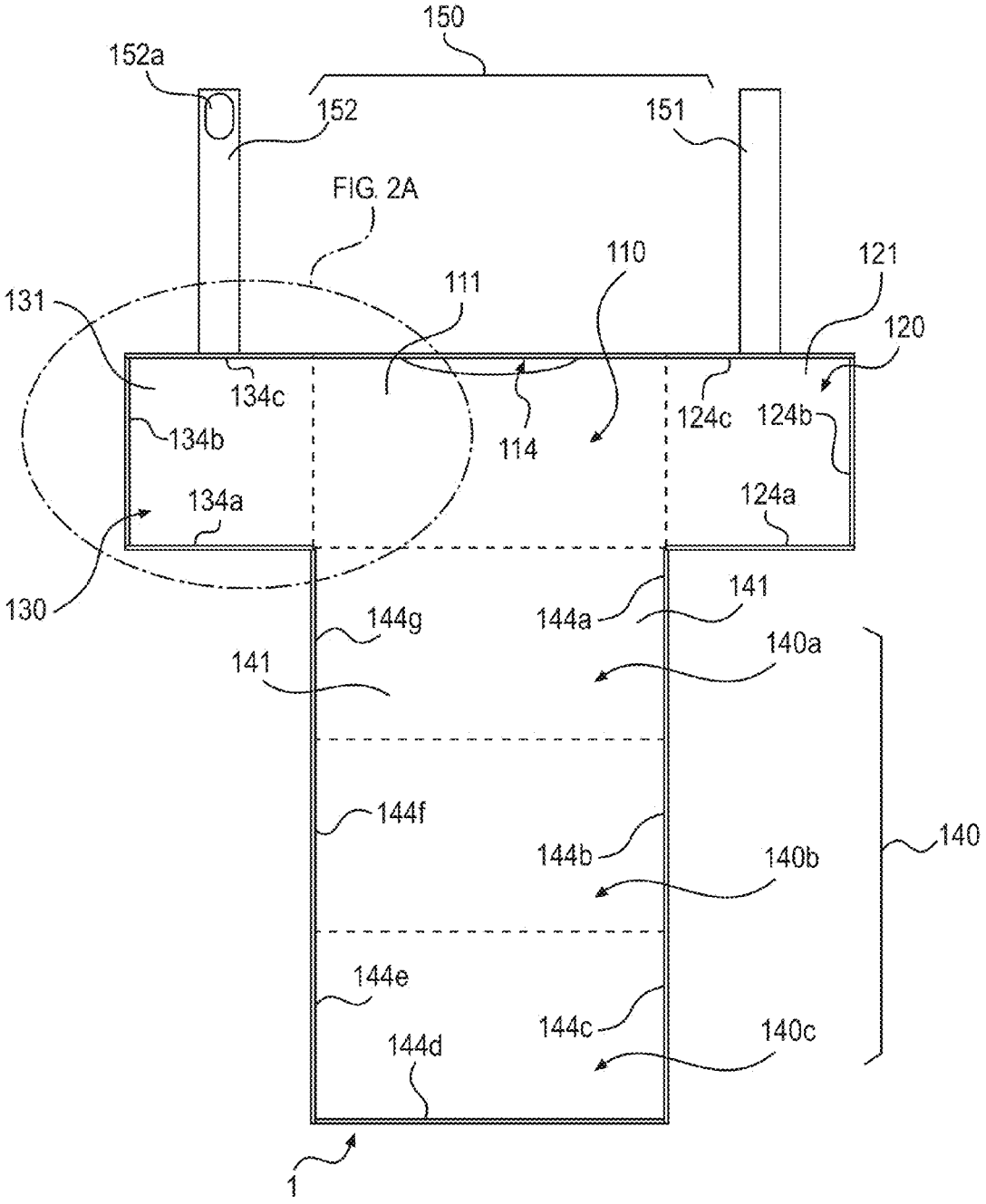
FIG. 2 is a schematic front elevational view of the embodiment of FIG. 1.
Figure 2A:
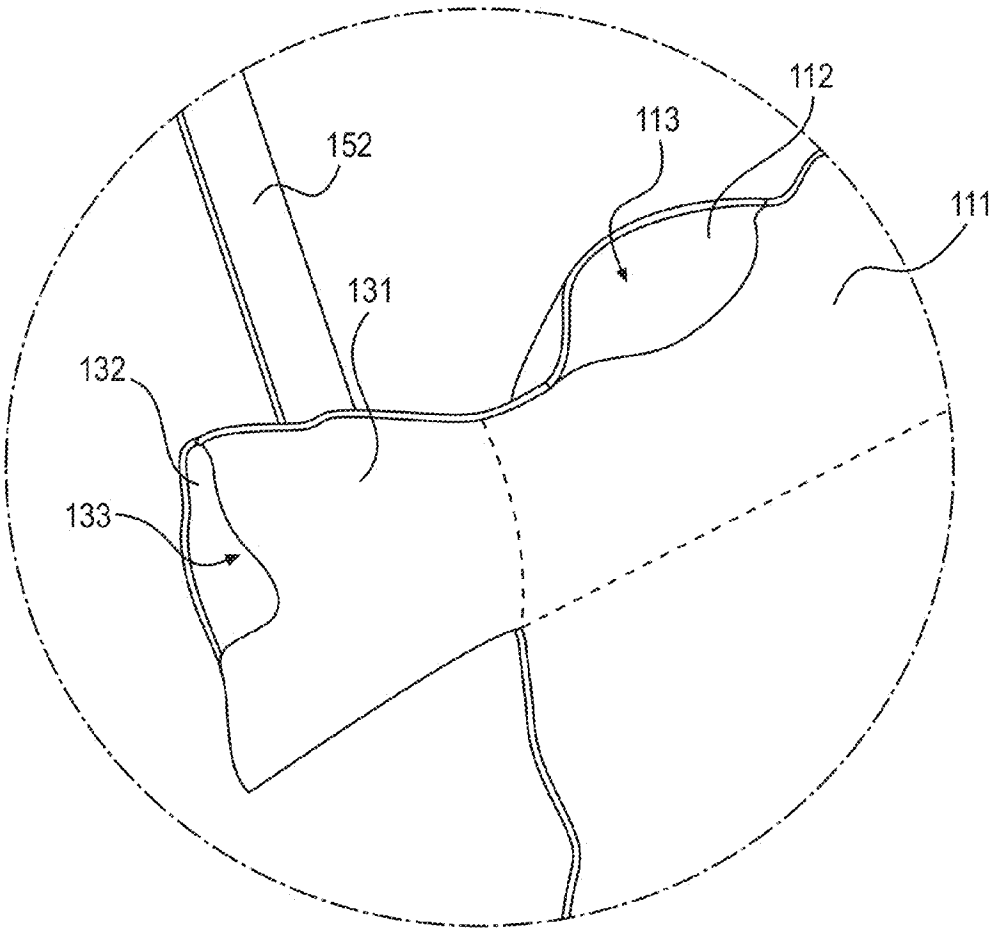
FIG. 2A is an enlarged detail view of the portion of the garment shown in the circle in FIG. 2.
Figure 3:
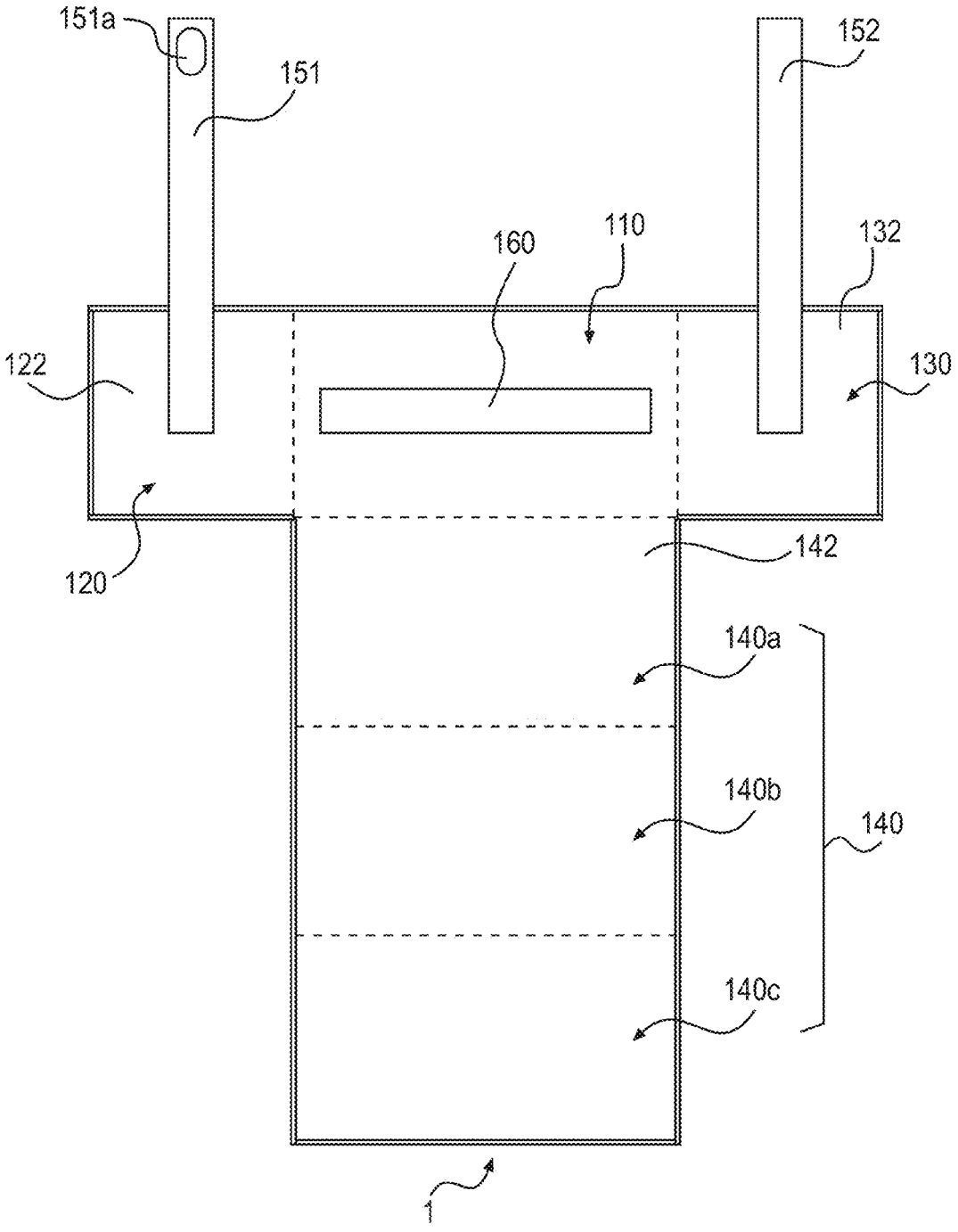
FIG. 3 is a schematic rear elevational view of the embodiment of FIG. 1.
Figure 4:
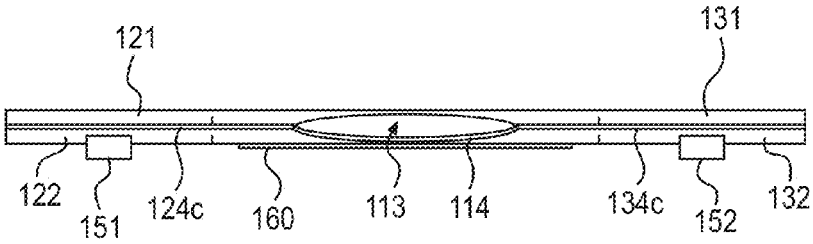
FIG. 4 is a schematic top plan view of the embodiment of FIG. 1.
Figure 5:
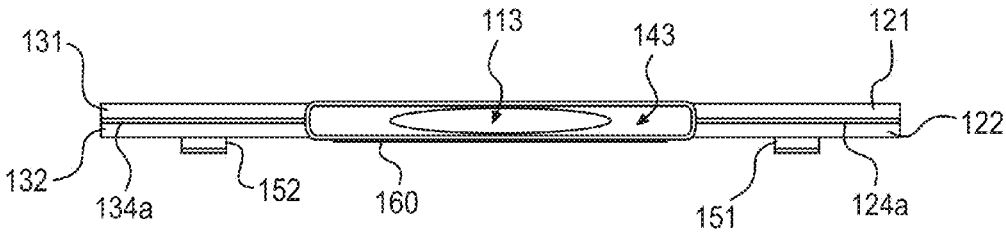
FIG. 5 is a schematic bottom plan view of the embodiment of FIG. 1.
Figure 6:
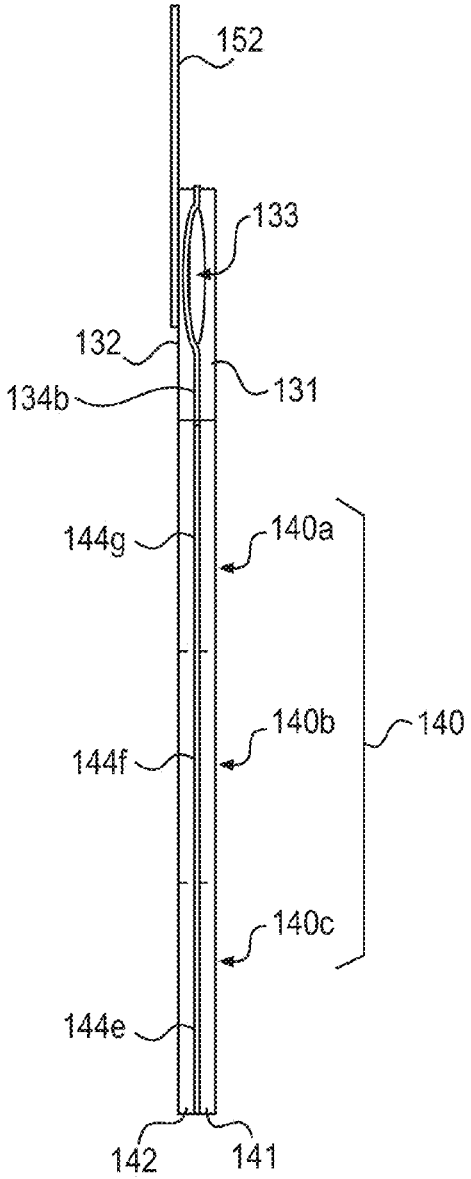
FIG. 6 is a schematic left side elevational view of the embodiment of FIG. 1.
Figure 7:
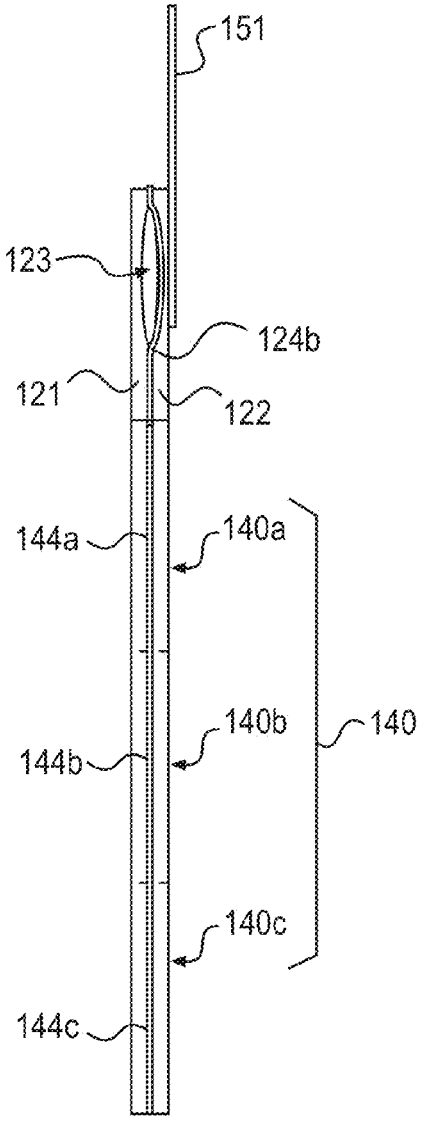
FIG. 7 is a schematic right side elevational view of the embodiment of FIG. 1.

According to one embodiment of the present disclosure, a garment convertible to a bag will be described with reference to FIGS. 1-7. FIG. 1 is a schematic perspective view of a garment 1 worn by a mannequin in an unfolded configuration, taken from front and on the right side according to an embodiment of the present invention. FIG. 2 is a schematic front elevational view of the garment 1. FIG. 2A is an enlarged detail view of the portion of the garment shown in the circle in FIG. 2. FIG. 3 is a schematic rear elevational view of the embodiment of FIG. 1. FIG. 4 is a schematic top plan view of the embodiment of FIG. 1. FIG. 5 is a schematic bottom plan view of the embodiment of FIG. 1. FIG. 6 is a schematic left side elevational view of the embodiment of FIG. 1. FIG. 7 is a schematic right side elevational view of the embodiment of FIG. 1.

With reference to FIGS. 1-7, a garment 1 includes a base member 110, a first sleeve member 120, a second sleeve member 130, and at least one body member 140. The garment 1 is convertible to a bag 1A and vice versa.

The garment 1 can be comprised of a pair of fabric. The base member 110 can be an integral part of at least one of the first and second sleeve members 120 and 130 and the body member 140. The first sleeve member 120 and the second sleeve member 130 are extended from the base member 110 respectively. At least one of the base member 110, the first sleeve member 120, the second sleeve member 130, and the at least one body member 140 is configured to be attachably and detachably coupled to at least another of the base member 110, the first sleeve member 120, the second sleeve member 130, and the at least one body member 140. For instance, the base member 110 is also configured to be attachably and detachably coupled to the body member 140. The first sleeve member 120 is configured to be attachably and detachably coupled to the body member 140. The second sleeve member 130 is configured to be attachably and detachably coupled to the body member 140. Thus, the base member 110, the first sleeve member 120, the second sleeve member 130, and the body member 140 can define a closed space, which can be used as the bag 1A (shown in FIG. 13).

The base member 110 includes a pair of base sides 111 and 112, a base opening 113, and a base coupling member 114. The pair of base sides is comprised of a front base side 111 and a rear base side 112. Each of the pair of base sides 111 and 112 can be made of fabric.

The base opening 113 can be located at the base member 110. The base opening 113 can be located at the periphery of the base member 110. For example, the base opening 113 can be defined between the pair of base sides 111 and 112. However, the location of the base opening 113 is not limited thereto, and the base opening 113 can be located at any part of the base member 110. For example, the base opening 113 can be located in the middle of the front base side 111. The number of the base opening 113 is not limited thereto and can vary depending on desired function and design. The size of the base opening 113 is suitably fabricated to fit a neck of human being.

The base coupling member 114 can be located on the periphery of the base member. The base coupling member 114 is configured to be attachably and detachably coupled to at least one of the first sleeve member 120, the second sleeve member 130, and the body member 140. For example, the base coupling member 114 is configured to be attachably and detachably coupled to the body member 140, when the user desires to convert the garment 1 to the bag 1A. The base coupling member 114 can include at least one of a zipper, a button, a velcro tape, a magnet, a hook, and snap fasteners.

FIGS. 2 and 3 shows rectangular shapes of the base member 110, the first sleeve member 120, the second sleeve member 130, and the body member 140 for exemplary purpose only, and the shapes of the same can vary depending on desired function and design. For instance, the base member 110, the first sleeve and the second sleeve members 120 and 130, and the body member 140 can have arbitrary polygonal shapes or curved shapes. For instance, it can be one of shapes of triangle, quadrilateral, pentagon, hexagon, octagon, cross, trapezoid, circle, and semicircle.

The first sleeve member 120 includes a pair of first sleeve sides 121 and 122, a first sleeve opening 123, and a first sleeve coupling member 124. The pair of first sleeve sides 121 and 122 is comprised of a first front sleeve side 121 and a first rear sleeve side 122. Each of the pair of first sleeve sides 121 and 122 can be made of fabric. For instance, fabric can include any material made through weaving, knitting, spreading, crocheting, or bonding, but not limited thereto. Fabric can include artificial fibers, or plastic.

The first sleeve opening 123 can be located at the first sleeve member 120. The first sleeve opening 123 can be located at the periphery. The first sleeve opening 123 can be defined between the pair of first sleeve sides 121 and 122. However, the location of the first sleeve opening 123 is not limited thereto, and the first sleeve opening 123 can be located at any part of the first sleeve member 120. For example the first sleeve opening 123 can be located at the middle of the first front sleeve side 121. The number of the first sleeve opening 123 is not limited thereto and can vary depending on desired function and design. The size of the first sleeve opening 123 is suitably fabricated to fit an arm of human being.

The first sleeve coupling member 124 includes a first bottom sleeve coupling member 124*a*, a first middle sleeve coupling member 124*b*, and a first top sleeve coupling member 124*c*.

Each of the first bottom sleeve coupling member 124*a*, the first middle sleeve coupling member 124*b*, and the first top sleeve coupling member 124*c* is located on the periphery of the first sleeve member 120. The first sleeve coupling member 124 is configured to be attachably and detachably coupled to at least one of the base member 110, the second sleeve member 130, and the body member 140. Each of the first bottom sleeve coupling member 124*a*, the first middle sleeve coupling member 124*b*, and the first top sleeve coupling member 124*c* can include at least one of a zipper, a button, a velcro tape, a magnet, a hook, and snap fasteners.

The second sleeve member 130 includes a pair of second sleeve sides 131 and 132, a second sleeve opening 133, and a second sleeve coupling member 134. The pair of second sleeve sides includes a second front sleeve side 131 and a second rear sleeve side 132. The second sleeve coupling member 134 includes a second bottom sleeve coupling member 134*a*, a second middle sleeve coupling member 134*b*, and a second top sleeve coupling member 134*c*. The second sleeve member 130 has corresponding elements to those of the first sleeve member 120, and an explanation thereof will thus be omitted. The first sleeve and the second sleeve members 120 and 130 can have a substantially same shape of one another. The first sleeve and second sleeve members 120 and 130 can be symmetrically or asymmetrically attached with respect to the base member 110.

The body member 140 can include at least one foldable portion. With reference to FIG. 2, for instance, the body member 140 includes three foldable portions: a top body member 140*a*, a middle body member 140*b*, and a bottom body member 140*c*. When the user desires to convert the garment 1 to the bag 1A, each portion of the top, middle, and bottom body member 140*a*, 140*b*, and 140*c* are foldable. FIG. 2 is shown for exemplary purposes only and the number, size, and shape of the foldable portions can vary depending on the design.

The body member 140 includes a pair of body sides 141 and 142, a body opening 143, and a body coupling member 144. The pair of body sides 141 and 142 includes a front body side 141 and a rear body side 142. The front body side 141 can cover one side of the top, middle, and bottom body member 140*a*, 140*b*, and 140*c*, and the rear body side 142 can cover the other side of the same.

Each of the pair of body sides 141 and 142 can be made of fabric. Fabric can include any material made through weaving, knitting, spreading, crocheting, or bonding, but not limited thereto. For instance, fabric can include artificial fibers, or plastic as well.

The body opening 143 is located at the body member 140. The body opening 143 can be located at the periphery of the body member 140. The body opening 143 can be defined between the pair of body sides 141 and 142. However, the location of the body opening 143 is not limited thereto, and the body opening 143 can be located at any part of the body member 140. For example, the body opening 143 can be located at the middle of any of the top, middle, and bottom body member 140*a*, 140*b*, and 140*c*. The size of the body opening 143 is suitably fabricated to fit legs of human being. The body opening 143 can be configured to be a single aperture so that legs of human being can pass though the body opening 143 and the body member 140 works as a skirt. In a variant embodiment, the body opening 143 can be configured to have a pair of apertures so that each of legs of human being passes through each of the pair of apertures. In this case, the body member 140 can work as pants. The number of the body opening 143 is not limited thereto and can vary depending on desired function and design.

The body coupling member 144 (not shown), for instance, can include a first, second, third, fourth, fifth, sixth, and seventh body coupling members 144*a*, 144*b*, 144*c*, 144*d*, 144*e*, 144*f*, and 144*g*, which are shown in FIG. 2 for exemplary purposes only, and the number, size, location, and shape of the body coupling member 144 can vary depending on the design.

The first and seventh body coupling members 144*a* and 144*g* are located at the periphery of the top body member 140*a*. The second and sixth body coupling members 144*b* and 144*f* are located at the periphery of the middle body member 140*b*. The third, fourth, and fifth body coupling members 144*c*, 144*d*, and 144*e* are located at the periphery of the bottom body member 140*c*.

Each of the first, second, and third body coupling members 144*a*, 144*b*, and 144*c* is configured to be attachably and detachably coupled to the first bottom, middle, and top sleeve coupling members 124*a*, 124*b*, and 124*c*, correspondingly. The fourth body coupling member 144*d* is configured to be attachably and detachably coupled to the base coupling member 114. Each of the fifth, sixth, and seventh body coupling members 144*e*, 144*f*, and 144*g* is configured to be attachably and detachably coupled to the first top, middle, and bottom sleeve coupling members 134*c*, 134*b*, and 134*a*.

The garment can include at least one strap. For instance, the garment can include a first shoulder strap 151, a second shoulder strap 152, and a hand strap 160. Each of the first shoulder strap 151, the second shoulder strap 152, and the hand strap 160 can locate at any part of the garment 1. FIG. 3 illustrates an example that the first shoulder strap 151, the second shoulder strap 152, and the hand strap 160 are located at the first sleeve member 120, the second sleeve member 130, and the base member 110 correspondingly, but the locations are not limited thereto. The first shoulder strap 151 includes a first shoulder strap coupling member 151*a*. The second shoulder strap 152 includes a second shoulder strap coupling member 152*a*. Each of the first shoulder strap coupling member 151*a* and second shoulder strap coupling member 152*a* can include a zipper, a button, a velcro tape, a magnet, a hook, and snap fasteners such that they are configured to be attachably and detachably coupled to one another. The garment 1 or the bag 1A can be established without the strap such that the user can use it as a pocket or a bag without a strap.

Figure 8:
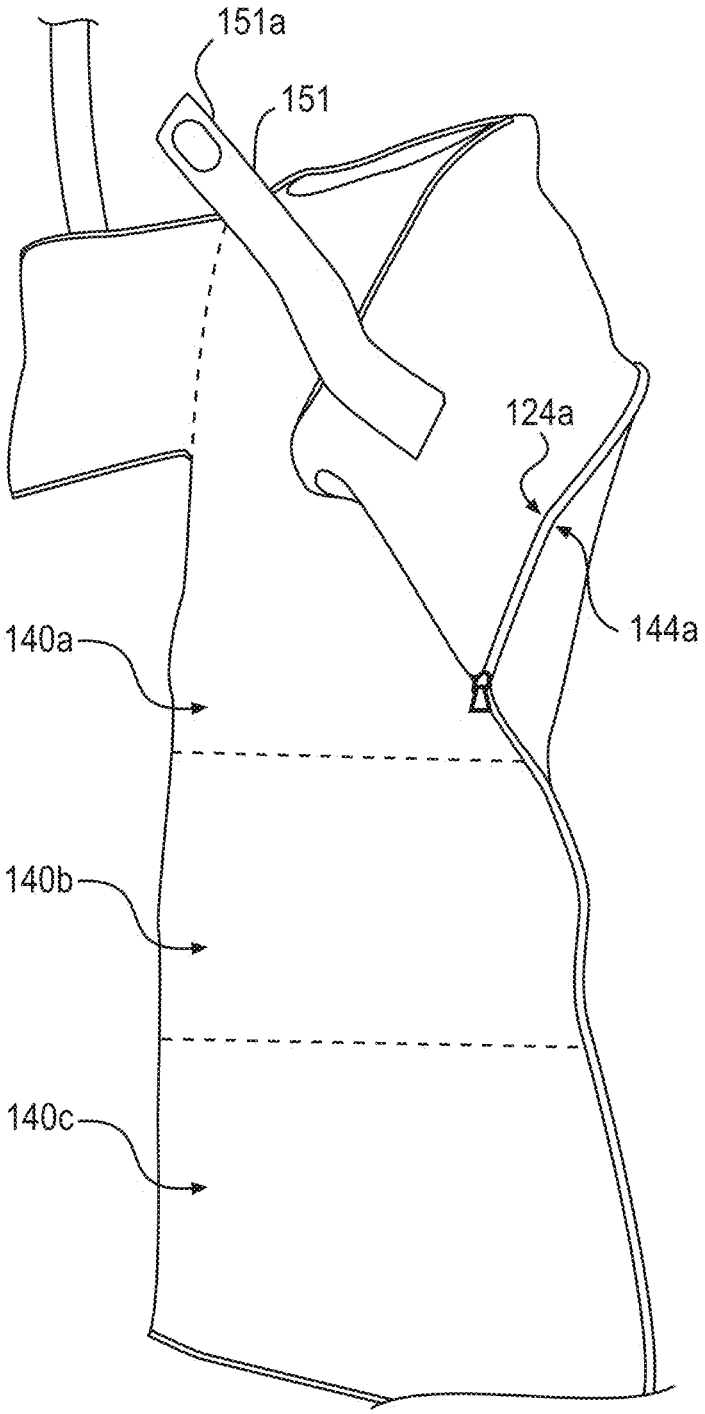
FIG. 8 illustrates the converting process from the garment shown in FIG. 2 to the bag by connecting the first sleeve member to the body member.
Figure 9:
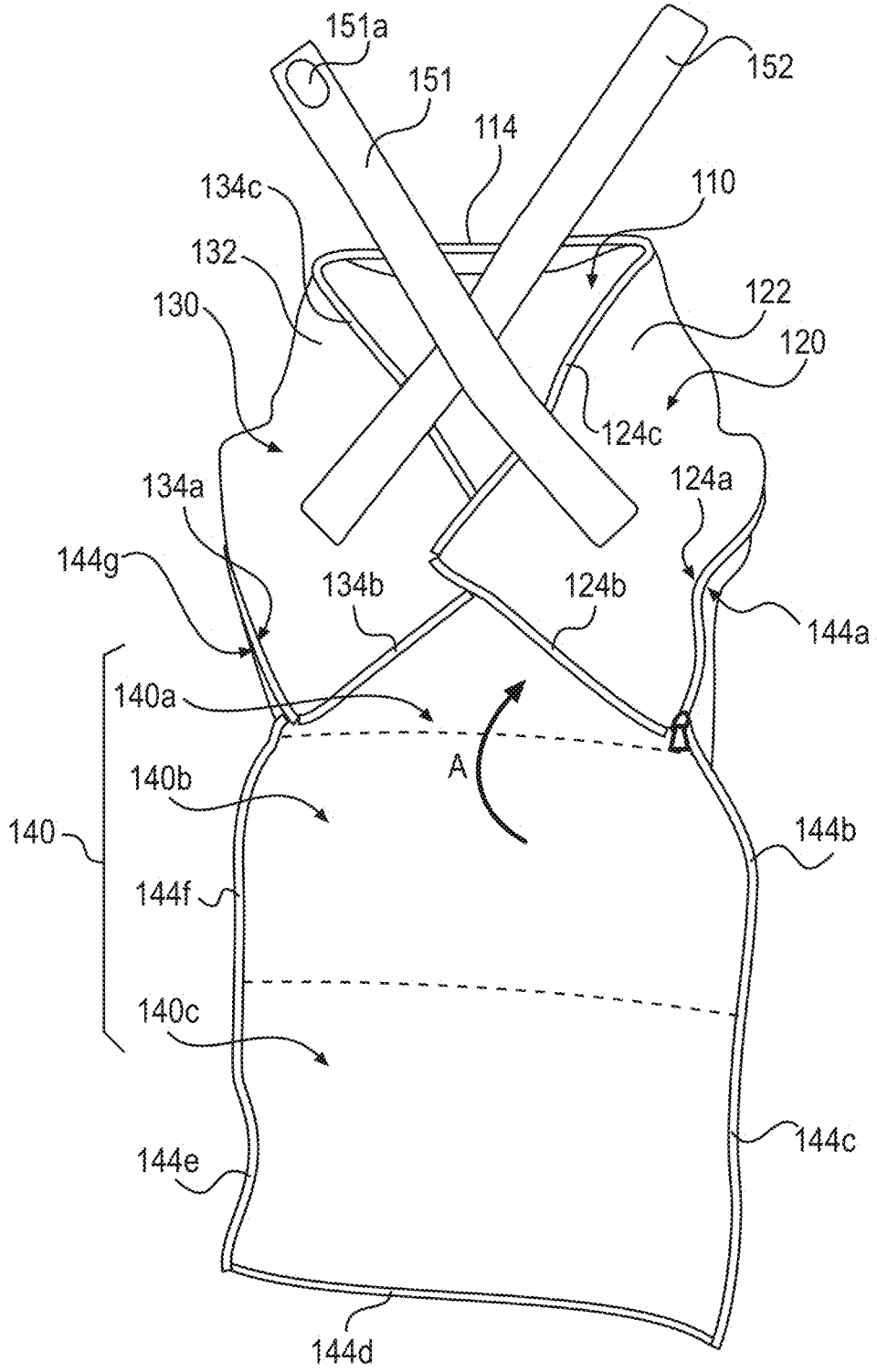
FIG. 9 illustrates the converting process from the garment shown in FIG. 8 to the bag by connecting the second sleeve member to the body member.
Figure 10:
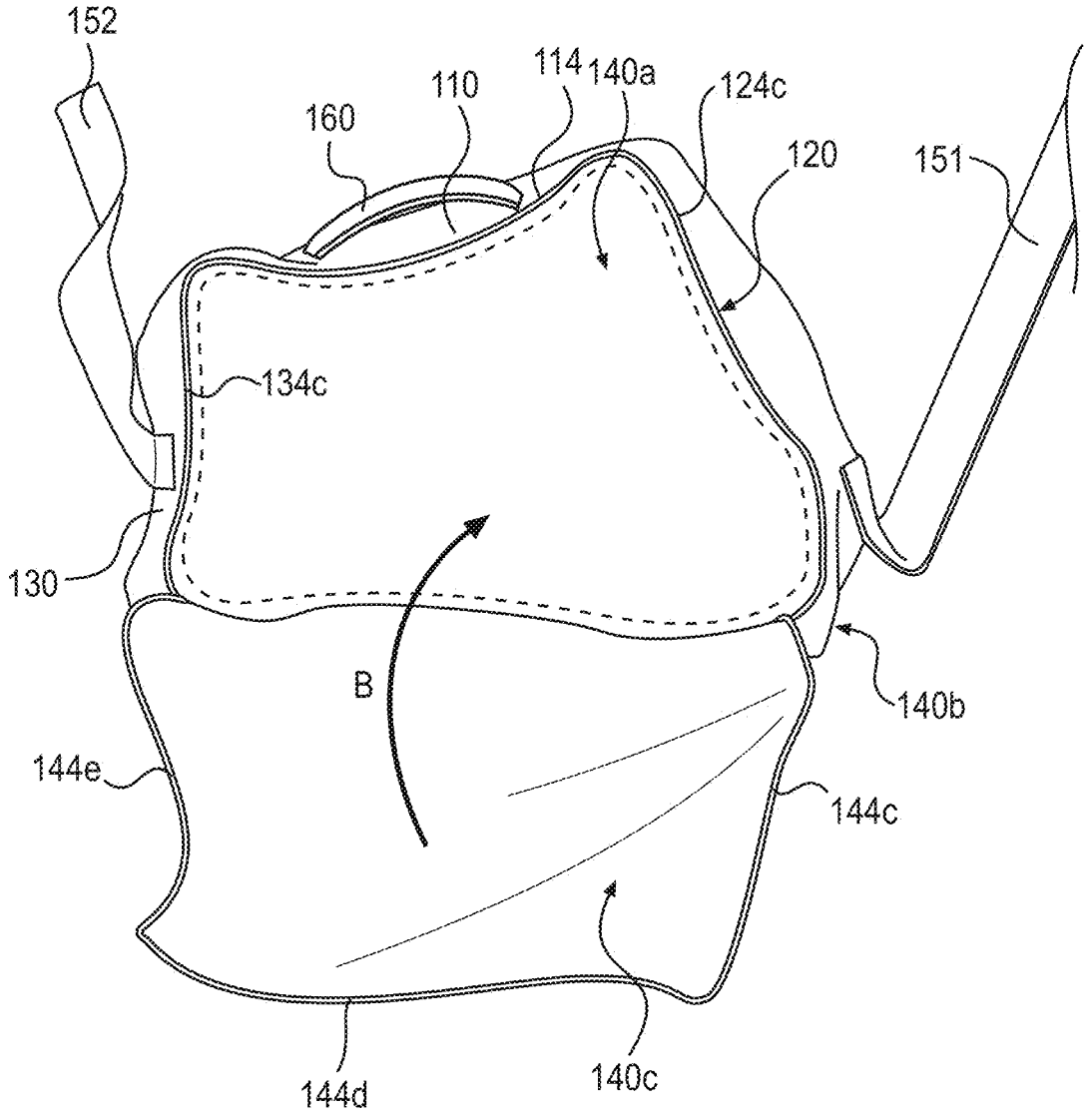
FIG. 10 illustrates the converting process from the garment shown in FIG. 9 to the bag by connecting further the first and second sleeve members to the body member.
Figure 11:
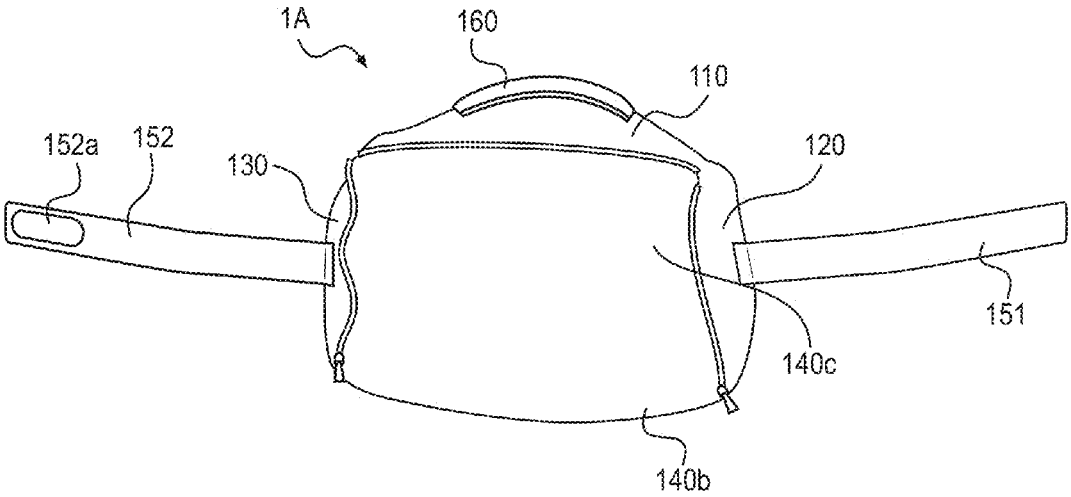
FIG. 11 is a schematic perspective view of the bag converted from the garment, taken from front.
Figure 12:
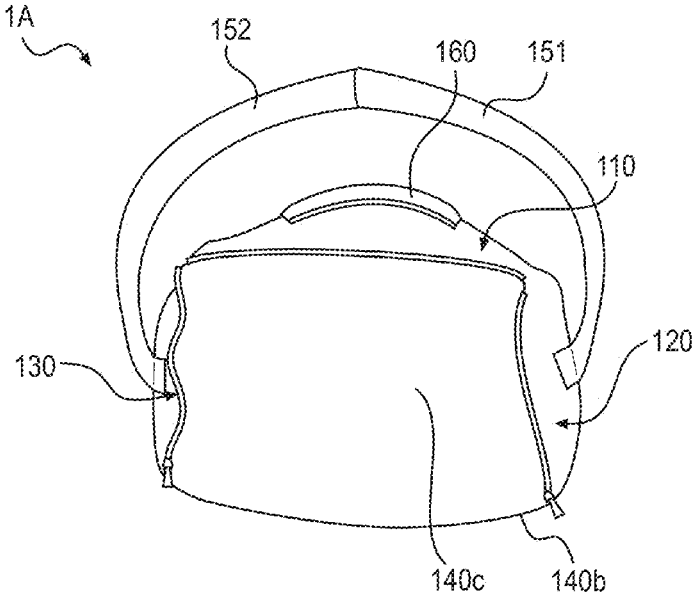
FIG. 12 is a schematic perspective view of the bag that is the same as FIG. 11, but with the shoulder strap being connected.

FIGS. 8-13 are schematic views illustrating the converting process from the garment 1 according to the first embodiment of the present invention to the bag 1A. FIG. 8 illustrates the converting process from the garment 1 shown in FIG. 2 to the bag 1A by connecting the first sleeve member to the body member. FIG. 9 illustrates the converting process from the garment shown in FIG. 8 to the bag by connecting the second sleeve member to the body member. FIG. 10 illustrates the converting process from the garment shown in FIG. 9 to the bag by connecting further the first and second sleeve members to the body member. FIG. 11 is a perspective view of the bag converted from the garment, taken from front. FIG. 12 is a perspective view of the bag that is the same as FIG. 11, but with the shoulder strap being connected.

First, as shown in FIG. 8, the first body coupling member 144*a* and the first bottom sleeve coupling member 124*a* are coupled to each other by coupling means such as a zipper, a button, a velcro tape, a magnet, a hook, and snap fasteners. Second, in a similar fashion, as shown in FIG. 9, the seventh first body coupling member 144*g* is coupled to the second bottom sleeve coupling member 134*a*. Third, as shown in FIG. 10, when the middle body member 140*b* is folded in a direction as depicted by the arrow A, the second and sixth body coupling members 144*b* and 144*f* are coupled to the first and second bottom sleeve coupling members 124*b* and 134*b* respectively. Fourth, with reference to FIGS. 10 and 11, as the bottom body member 140*c* is folded in a direction as depicted by the arrow B in FIG. 10, the bottom body member 140*c* is coupled to the base coupling member 114. Thus, the base member 110, the first sleeve member 120, the second sleeve member 130, and the body member 140 can define a close space as illustrated in FIG. 11.

Figure 13:
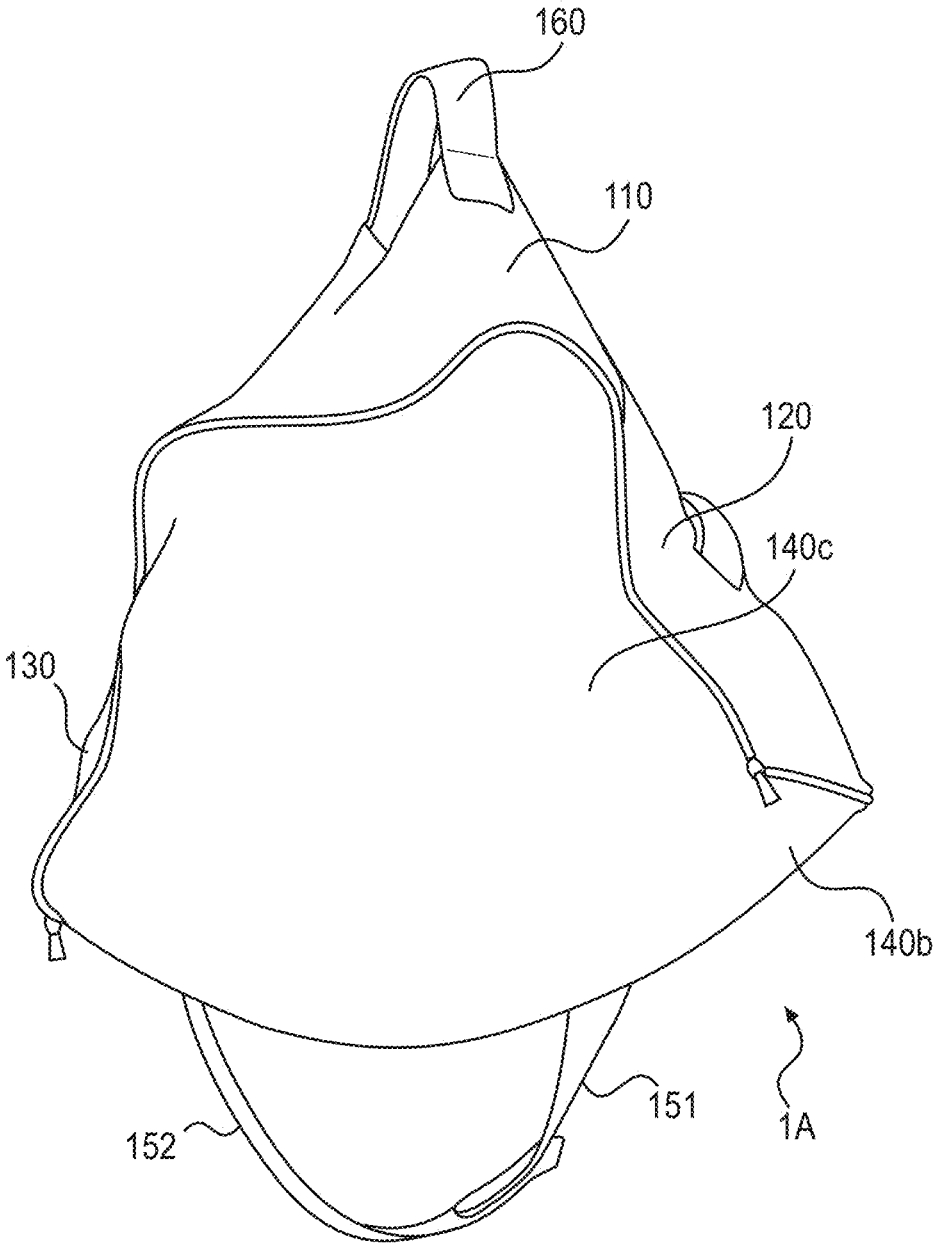
FIG. 13 is a schematic perspective view of the bag converted from the garment, taken from front in an folded configuration.

Lastly, FIG. 12 illustrates that the first shoulder strap coupling member 151*a* is connected to the second shoulder strap coupling member 152*a* such that if desired the user can use the shoulder strap for carrying the bag 1A. FIG. 13 illustrates a perspective view of the bag 1A which is successfully converted from the garment 1 and ready for a use as a bag 1A.

Figure 14A:
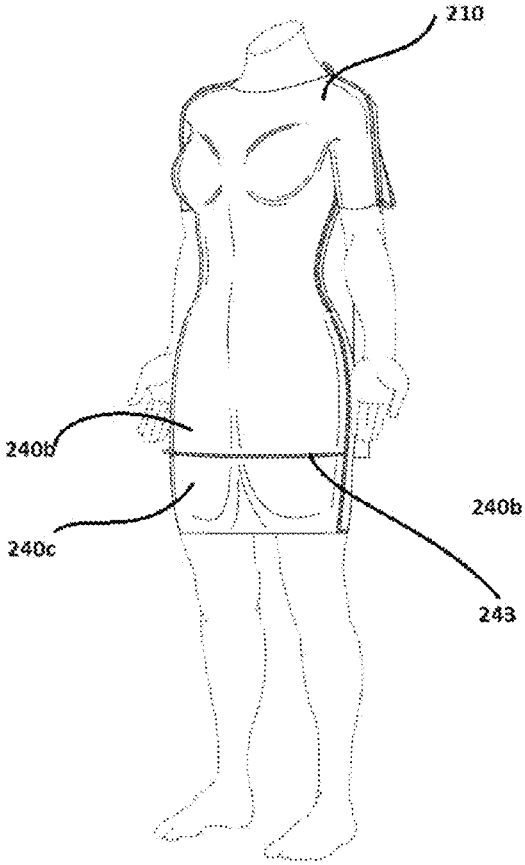
FIG. 14A is a perspective view of a garment worn by a mannequin with a front zipper in a closed configuration, taken from front and on the right side.
Figure 14B:
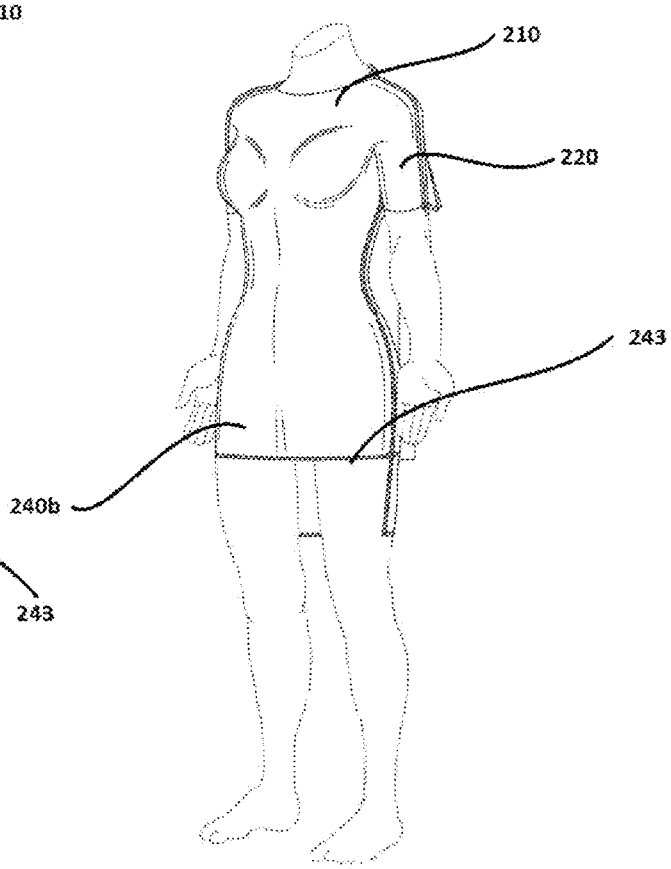
FIG. 14B is a perspective view of FIG. 14B with a front zipper in an opened configuration.
Figure 14C:
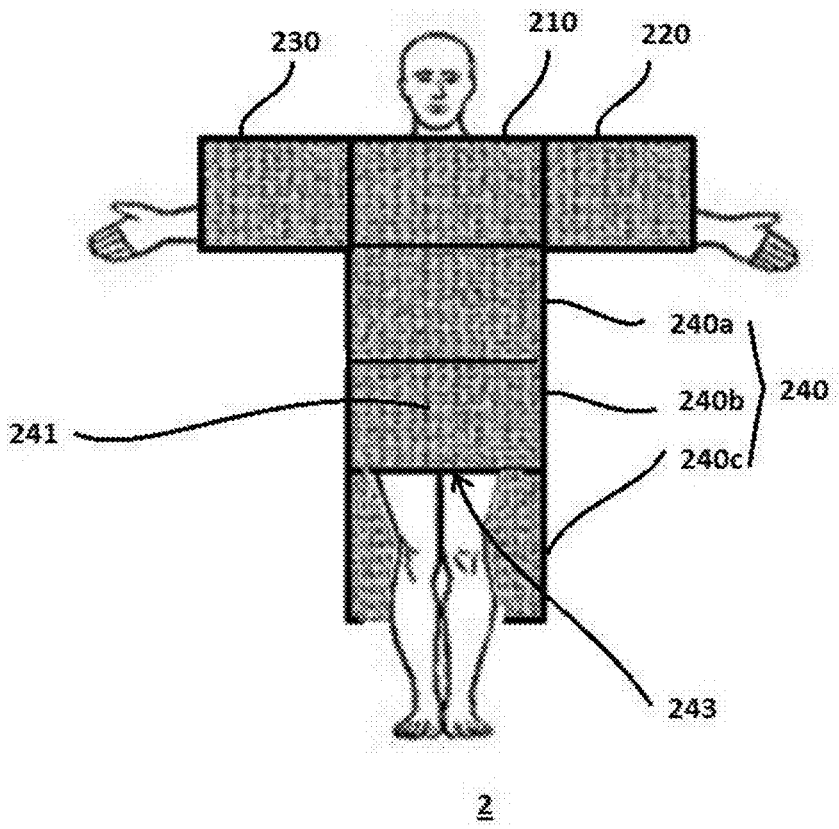
FIG. 14C is a schematic front view of another embodiment of FIG. 14B.

FIG. 14A is a perspective view of a garment worn by a mannequin with a front zipper in a closed configuration, taken from front and on the right side. FIG. 14B is a perspective view of FIG. 14B with a front zipper in an opened configuration. FIG. 14C is a schematic front view of another embodiment of FIG. 14B.

A garment 2 includes a base member 210, a first sleeve member 220, a second sleeve member 230, and at least one body member 240. The body member 240 includes three foldable portions: a top body member 240*a*, a middle body member 240*b*, and a bottom body member 240*c*. The body member 240 is comprised of a front body side 241 and a rear body side 242 (not shown). FIGS. 14A-C illustrate that the body opening 243 is formed on the front body member 241, especially between the middle body member 240*b* and the bottom body member 240*c*. The body opening 243 is formed when a zipper located in the front body side 241 is open. The body member 240 may include a plurality of openings.

Figure 15:
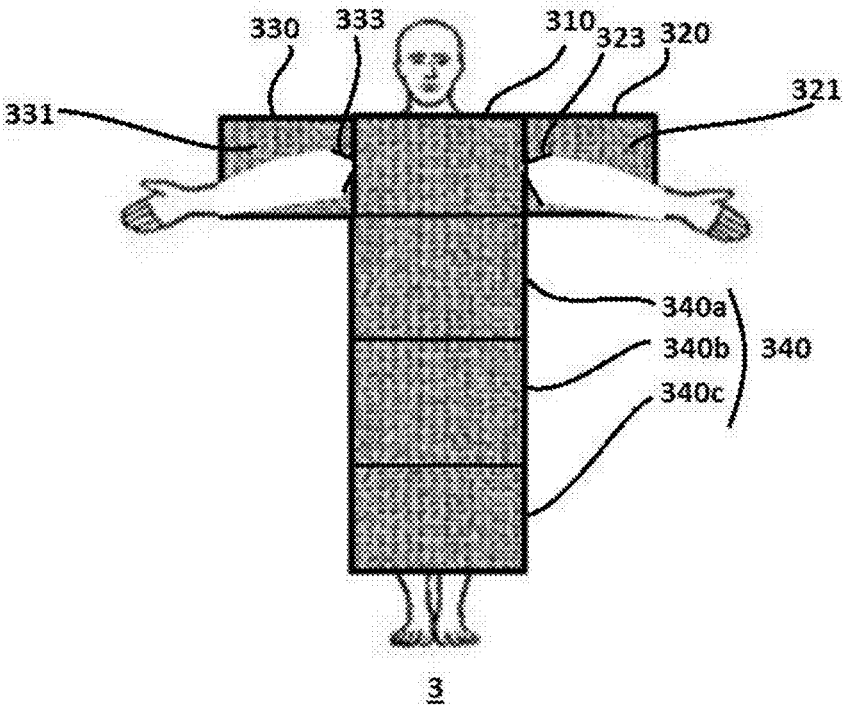
FIG. 15 is a schematic front view of the other embodiment of the present invention.

FIG. 15 is a schematic view of the other embodiment of the present invention. A garment 3 includes a base member 310, a first sleeve member 320, a second sleeve member 330, and at least one body member 340. The body member 340 includes three foldable portions: a top body member 340*a*, a middle body member 340*b*, and a bottom body member 340*c*. The first sleeve member 320 is comprised of a first front sleeve side 321 and a first rear sleeve side 322 (not shown). The second sleeve member 330 is comprised of a second front sleeve side 331 and a second rear sleeve side 322 (not shown). FIG. 15 illustrates that the first sleeve opening 323 is formed on the first front sleeve member 321 close to the base member 310, and the second sleeve opening 333 is formed on the second front sleeve member 331 close to the base member 310.

Figure 16:
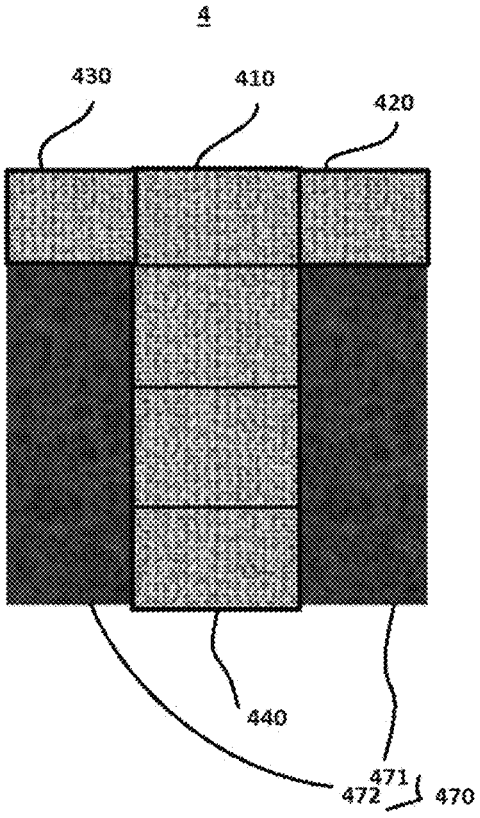
FIG. 16 is a schematic front view of the other embodiment of the present invention.

FIG. 16 is a schematic front view of the other embodiment of the present invention. A garment 4 includes a base member 410, a first sleeve member 420, a second sleeve member 430, at least one body member 440, and a fabric member 470.

The fabric member 470 includes a first fabric member 471 and a second fabric member 472. The first and second fabric members 471 and 472 are symmetrically or asymmetrically attached to at least one of the base member 410, the first sleeve member 420, the second sleeve member 430, and the at least one body member 440 with respect to a centerline (not shown) of the base member 410. The first and second fabric members 471 and 472 can have arbitrary shapes and be a part of the garment 4. The first and second fabric members 471 and 472 are configured to be releasably folded into the bag (not shown) which is converted from the garment 4.

Figure 17:
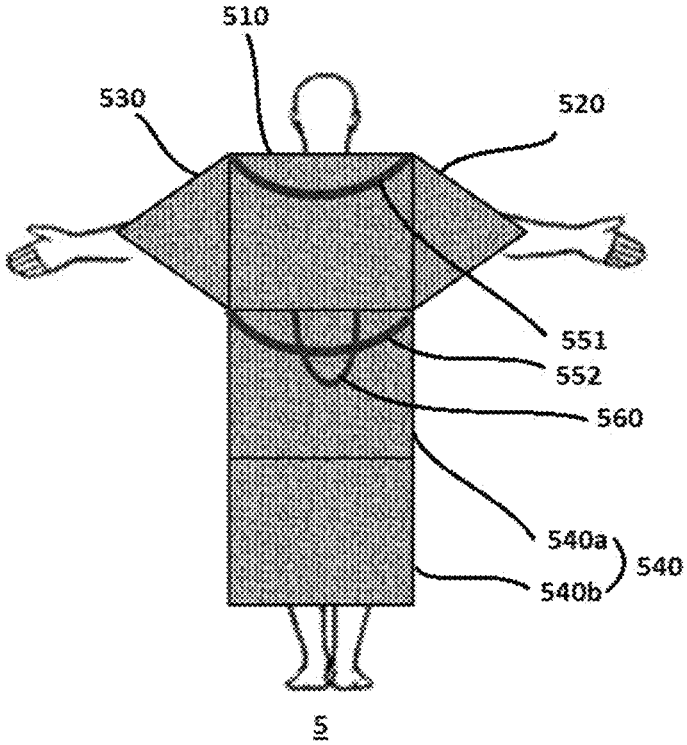
FIG. 17 is a schematic rear view of the other embodiment of the present invention.
Figure 18:
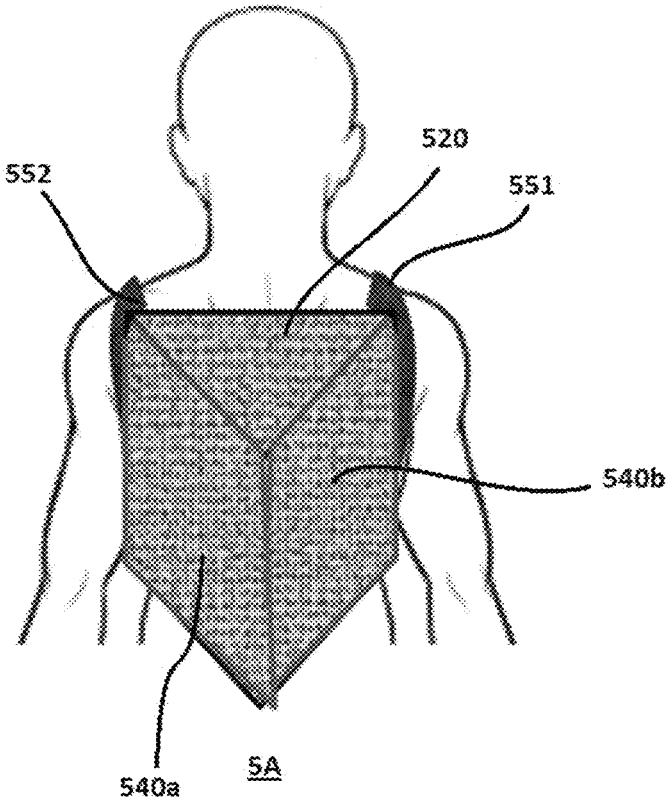
FIG. 18 is a schematic perspective schematic view of the bag, worn by a user, converted from the garment illustrated in FIG. 17

With reference to FIGS. 17 and 18, the other embodiment of the present invention will be described. FIG. 17 is a schematic rear view of the other embodiment of the present invention. FIG. 18 is a perspective schematic view of the bag, worn by a user, converted from the garment 5 illustrated in FIG. 17. A garment 5 includes a base member 510, a first sleeve member 520, a second sleeve member 530, at least one body member 540, a first and second shoulder strap 551 and 552, and a hand strap 560. FIG. 18 illustrates the bag 5A which is converted from the garment 5 and worn on the back.

The first and second sleeve members 510 and 520 have a triangular shape. The body member 540 includes two foldable portions: a top body member 540*a*, and a bottom body member 540*b*. The shapes of the first and second sleeve members 520 and 530 can vary depending on desired function and design, and body member 540 can have a number of foldable portions in response to the number of sides of the first and second sleeve members 520 and 530. Each of the first and second sleeve members 520 and 530 has three sides, one side abutting on the base member 510. The body member 540 has two foldable portions corresponding to the two remaining sides. Thus, when each of the first and second members 520 and 530 has an n-sided polygon, having one side abutting on the base member 510, the body member 540 can have an (n−1) foldable portions. The body member 540 can be extended from the base member 510 in proportion to the length of a perimeter of the first and second sleeve members 520 and 530. Each of the first and second shoulder straps 551 and 552 constitutes two shoulder straps when the bag 5A is used as a backpack.

Figure 19:
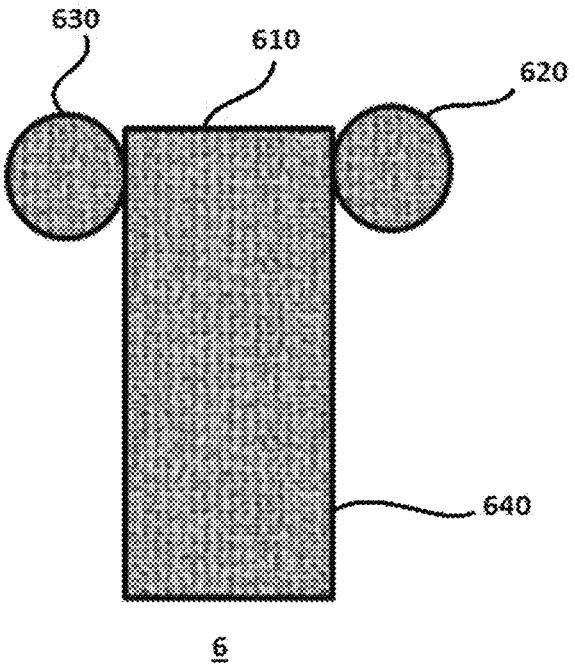
FIG. 19 is a schematic front view of the other embodiment of the present invention.
Figure 20:
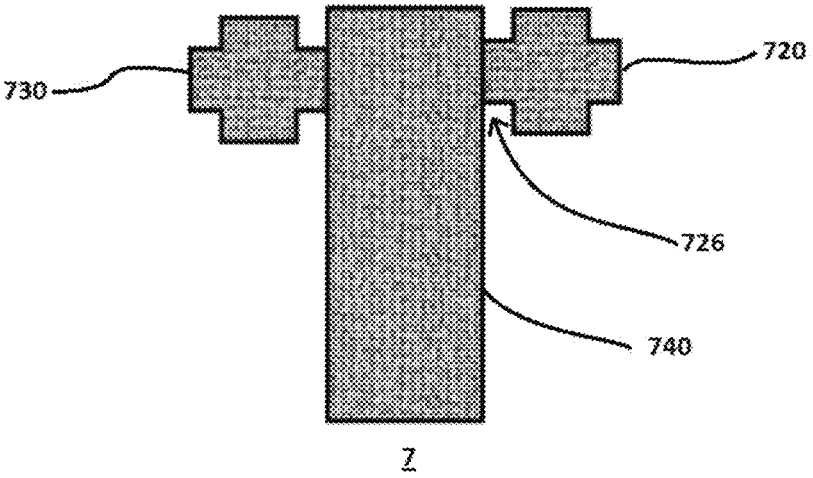
FIG. 20 is a schematic front view of the other embodiment of the present invention.

Each of the first sleeve and the second sleeve members 520 and 530 can have a cross shape or a curved shape. With reference to FIGS. 19 and 20, the other embodiment of the present invention will be described.

FIG. 19 is a schematic front view of the other embodiment of the present invention. A garment 6 includes a base member 610, a first sleeve member 620, a second sleeve member 630, a body member 640. Each of the first and second sleeve members 620 and 630 has a circular shape. The body member 640 is an integral part of the base member 610, and the body member 640 is extended from the base member 610 in proportion to the length of a circumference of each of the first and second sleeve members 620 and 630.

FIG. 20 is a schematic front view of the other embodiment of the present invention. A garment 7 includes a base member 710, a first sleeve member 720, a second sleeve member 730, a body member 740. Each of the first and second sleeve members 720 and 730 has a cross shape. The first and second sleeve members 720 and 730 have a gap 726 therein, and thus when the garment 7 is converted to a bag (not shown), the bag has a gap 726 or a hole on its surface.

Figure 21:
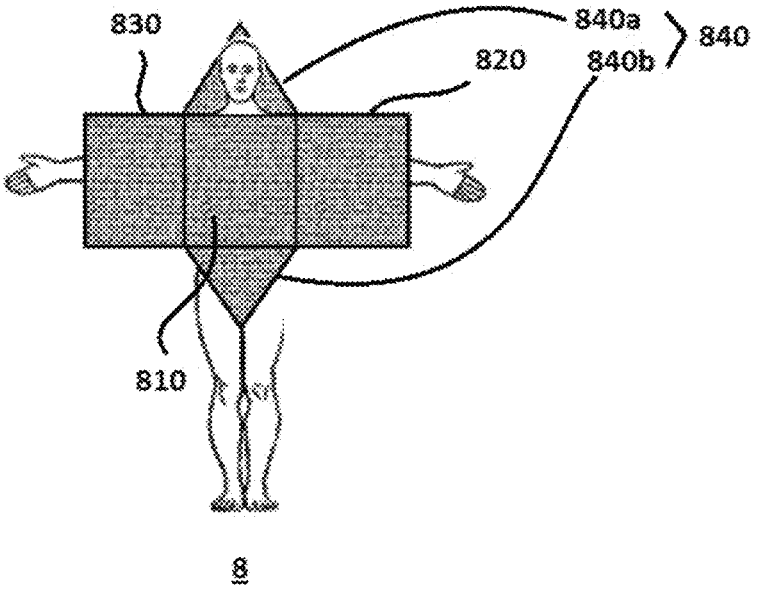
FIG. 21 is a schematic front view of the other embodiment of the present invention.

FIG. 21 is a schematic front view of the other embodiment of the present invention. A garment 8 includes a base member 810, a first sleeve member 820, a second sleeve member 830, and at least one body member 840. The at least one body member 840 includes a first body member 840*a* and a second body member 840*b*. Each of the first and second body members 840*a* and 840*b* is extended from the base member 810 in opposite directions to each other. The first body member 840*a* located near to base opening (not shown in FIG. 21) can work as a hood.

Figure 22:
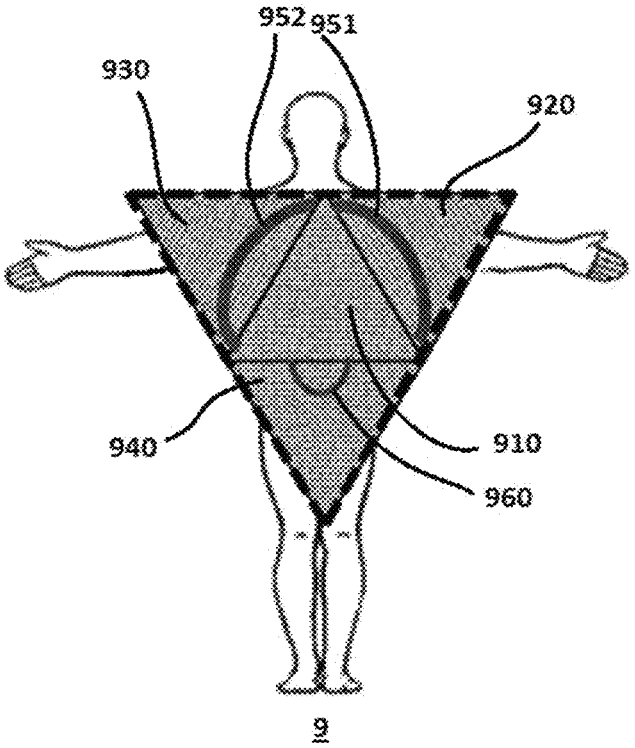
FIG. 22 is a schematic rear view of the other embodiment of the present invention.
Figure 23:
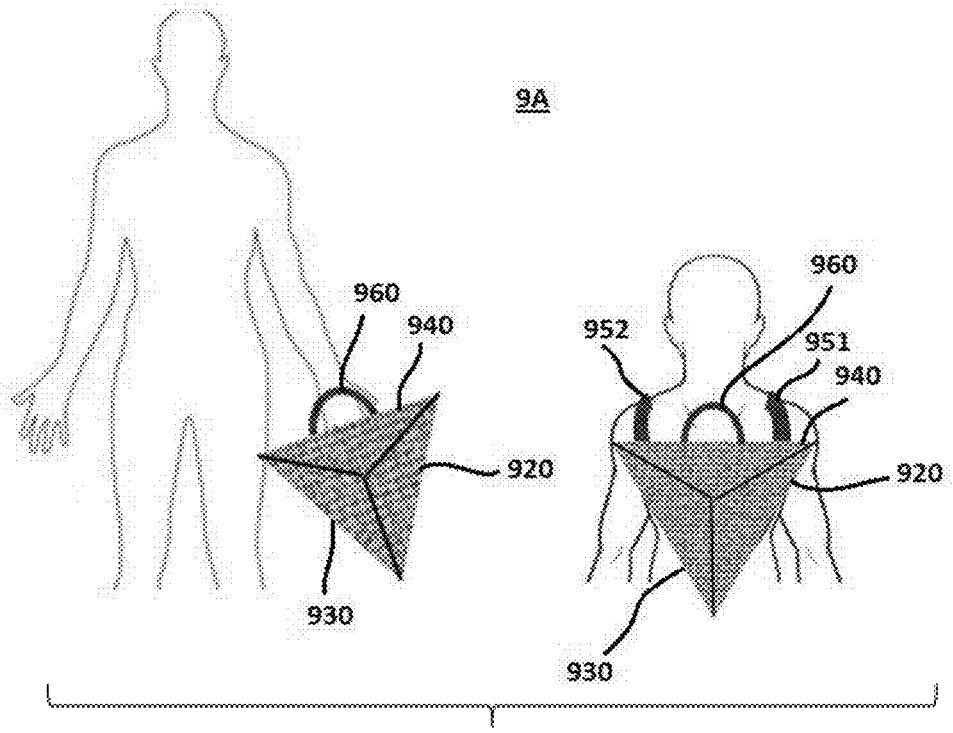
FIG. 23 is a schematic perspective schematic view of the bag, carried and worn by a user, converted from the garment illustrated in FIG. 22

FIG. 22 is a schematic rear view of the other embodiment of the present invention. FIG. 23 is a perspective schematic view of two bags, one of which is carried as a tote bag and the other is worn by a user as a backpack, converted from the garment illustrated in FIG. 22. A garment 9 includes a base member 910, a first sleeve member 920, a second sleeve member 930, at least one body member 940, a shoulder strap 950, and a hand strap 960. The shoulder strap 950 includes a first shoulder strap 951 and a second shoulder strap 952. The base member 910, the first and second sleeve members 920 and 930, and the body member 940 have a triangular shape. The bag 9A converted from the garment 9 has a pyramid shape. The pyramid shape bag 9A can be used as a backpack or a tote bag.

Figure 24:
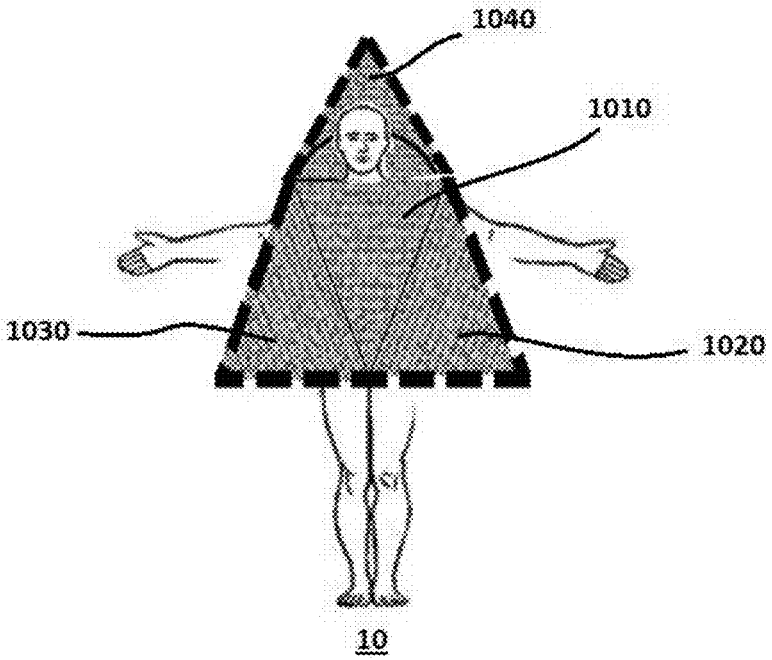
FIG. 24 is schematic front view of the other embodiment of the present invention.

FIG. 24 is a schematic front view of the other embodiment of the present invention. A garment 10 includes a base member 1010, a first sleeve member 1020, a second sleeve member 1030, and at least one body member 1040. The base member 1010, the first and second sleeve member 1020 and 1030, and the body member 1040 have a triangular shape. The body member 1040 can work as a hood.

Figure 25:
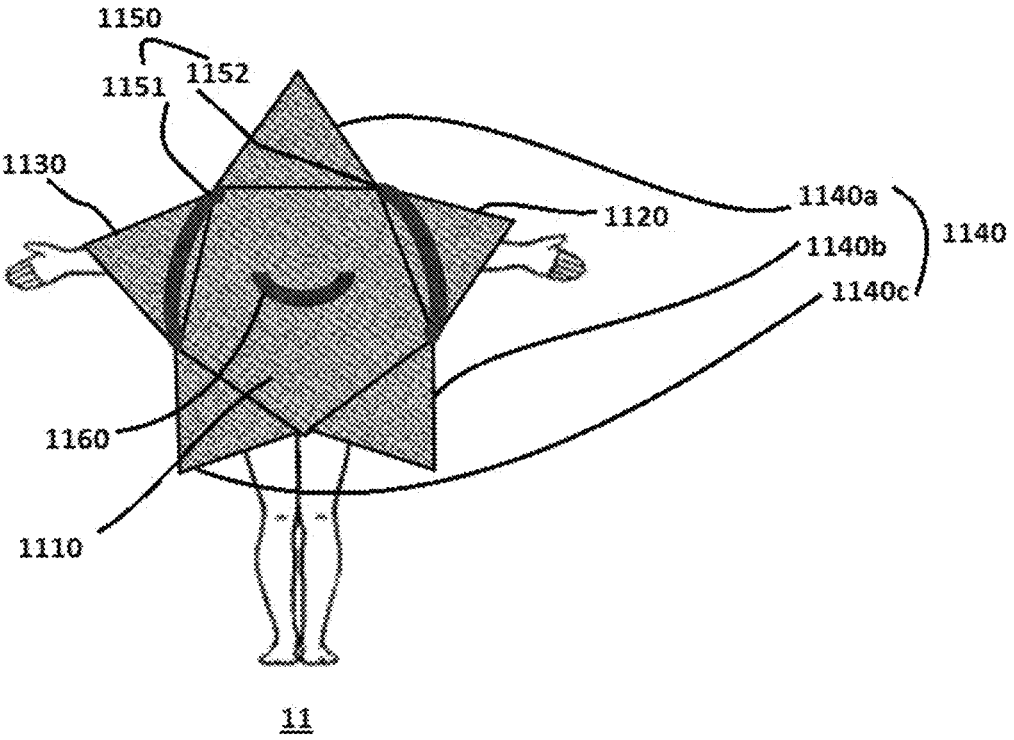
FIG. 25 is a schematic rear view of the other embodiment of the present invention.
Figure 26:
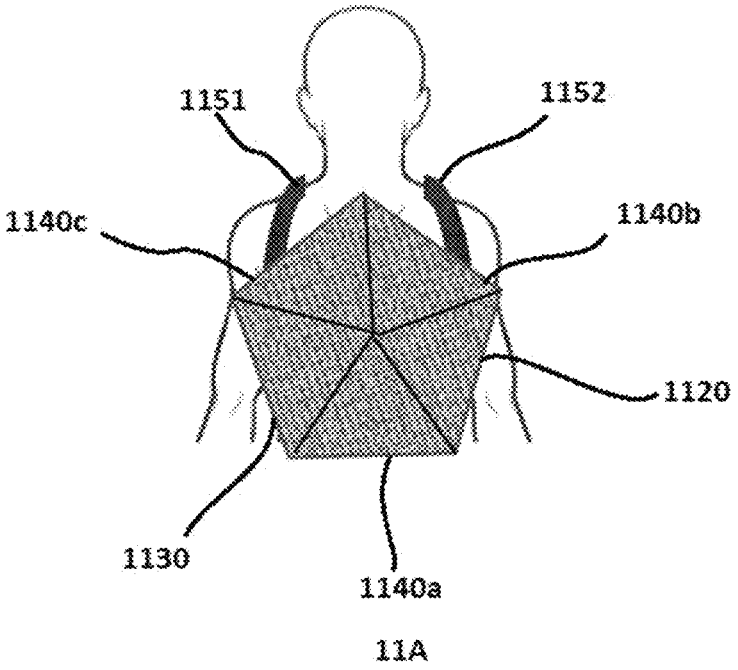
FIG. 26 is a schematic perspective schematic view of the bag, worn by a user, converted from the garment illustrated in FIG. 25

FIG. 25 is a schematic rear view of the other embodiment of the present invention. FIG. 26 is a perspective schematic view of the bag, worn by a user, converted from the garment illustrated in FIG. 25. A garment 11 includes a base member 1110, a first sleeve member 1120, a second sleeve member 1130, at least one body member 1140, a shoulder strap 1150, and a hand strap 1160. The at least one body member 1140 includes a first body member 1140*a*, a second body member 1140*b*, and a third body member 1140*c*. The first body member located near a base opening (not shown in FIG. 25) can work as a hood.

The base member 1110 has a pentagon shape. The first and second sleeve members 1120 and 1130, and the first, second, and third body members 1140*a*, 1140*b*, and 1140*c* have a triangular shape. The bag 11A converted from the garment 11 has a pentagonal pyramid shape. The shoulder strap 1150 includes a first shoulder strap 1151 and a second shoulder strap 1152.

Figure 27:
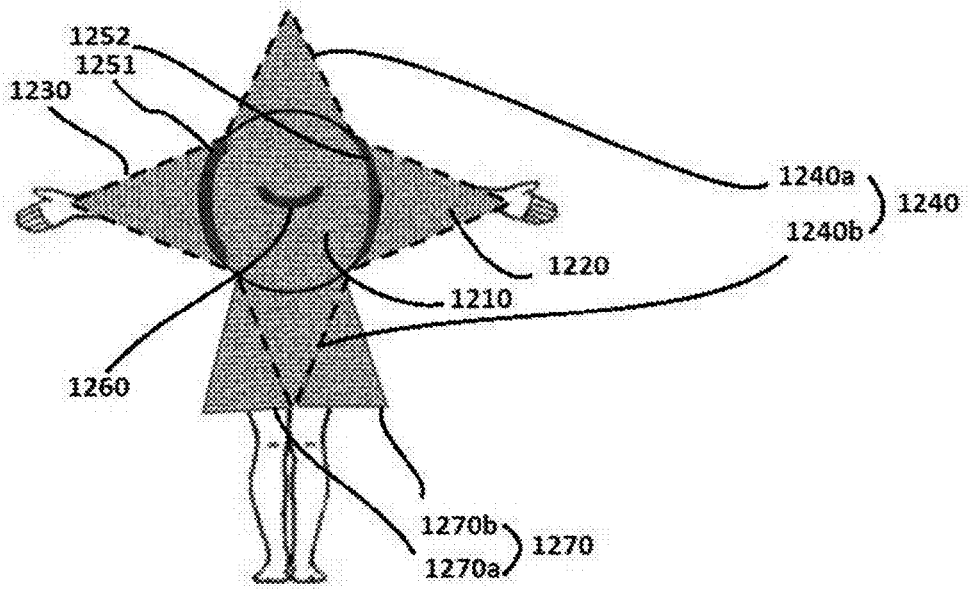
FIG. 27 is a schematic rear view of the other embodiment of the present invention.

FIG. 27 is a schematic rear view of the other embodiment of the present invention. A garment 12 includes a base member 1210, a first sleeve member 1220, a second sleeve member 1230, at least one body member 1240, a shoulder strap 1250, a hand strap 1260, a fabric member 1270. The at least one body member 1240 includes a first body member 1240*a* and a second body member 1240*b*. The fabric member 1270 includes a first fabric member 1270*a* and a second fabric member 1270*b*, which are extended from the second body member 1240*b*. The first and second fabric members 1270*a* and 1270*b* are configured to be releasably folded into the bag (not shown in FIG. 27) which is converted from the garment 12. The first body member 1240*a* located near a base opening (not shown in FIG. 27) can work as a hood. A bag converted from the garment 12 has a circular cone shape.

Figure 28:
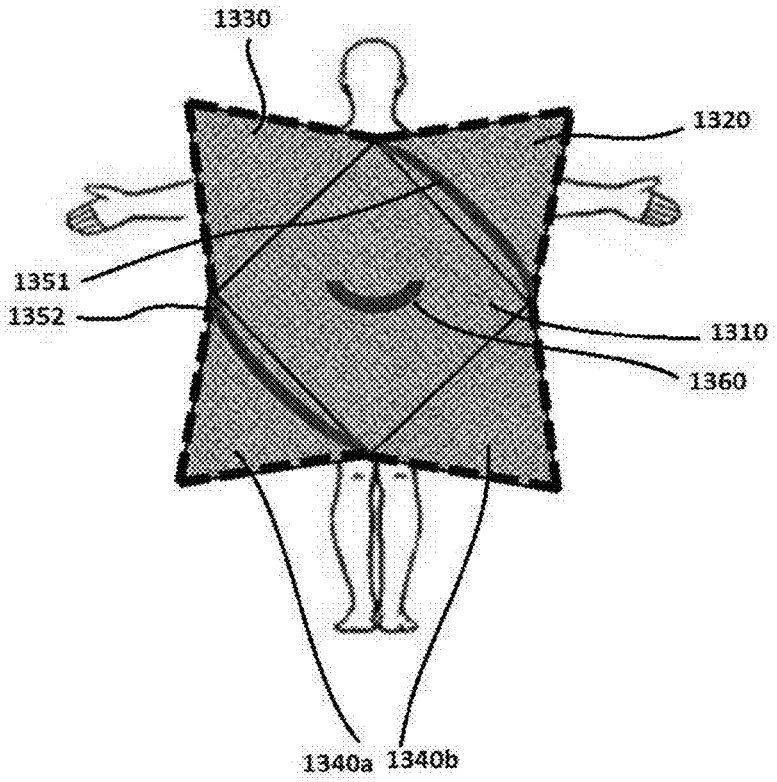
FIG. 28 is a schematic rear view of the other embodiment of the present invention.

FIG. 28 is a schematic rear view of the other embodiment of the present invention. A garment 13 includes a base member 1310, a first sleeve member 1320, a second sleeve member 1330, at least one body member 1340, a shoulder strap 1350, a hand strap 1360. The at least one body member 1340 includes a first body member 1340*a* and a second body member 1340*b*. A bag (not shown in FIG. 28) converted from the garment 13 has a pyramid shape.

It is to be understood that the exemplary embodiments described herein are that for present embodiments and thus should be considered in a descriptive sense only and not for purposes of limitation. The modifications and embodiments are intended to be included within the scope of the dependent claims. Descriptions of features or aspects within each embodiment should typically be considered as available for other similar features or aspects in other embodiments. Many modifications and other embodiments of the disclosure will come to the mind of one skilled in the art having the benefit of the teaching presented in the forgoing descriptions and the associated drawings.

What is claimed is:

1. A garment convertible to a bag comprising, a base member comprising a pair of base sides, a base opening, and a base coupling member on the periphery of the base member;

a first sleeve member extending in a transverse direction from the base member, wherein the first sleeve member comprises a pair of first sleeve sides, a first sleeve opening, and a first sleeve coupling member on the periphery of the first sleeve;

a second sleeve member extending in a transverse direction from the base member, wherein the second sleeve member comprises a pair of second sleeve sides, a second sleeve opening, and a second sleeve coupling member on the periphery of the second sleeve; and at least one body member extending in a longitudinal direction from the base member wherein the at least one body member comprises a pair of body sides, a body opening, and at least one body coupling member on the periphery of the body member, wherein at least one of the base member, the first sleeve member, the second sleeve member, and the at least one body member is configured to be attachably and detachably coupled to at least another of the base member, the first sleeve member, the second sleeve member, and the at least one body member to define the bag, and wherein each and every one of the base member, the first sleeve member, the second sleeve member, and at least one body member constitutes at least a part of an exterior surface of the bag.

2. The garment of claim 1, wherein the body member is attachably and detachably coupled to at least one of the first sleeve member, the second sleeve member, and the base member, wherein the first sleeve member is attachably and detachably coupled to at least one of the base member, and the body member, and wherein the second sleeve member is attachably and detachably coupled to at least one of the base member and the body member.

3. The garment of claim 1, wherein the at least one body coupling member comprises a first body coupling member, a second body coupling member, and a third body coupling member, wherein the first body coupling member is attachably and detachably coupled to the base coupling member, wherein the second body coupling member is attachably and detachably coupled to the first sleeve coupling member, and wherein the third body coupling member is attachably and detachably coupled to the second sleeve coupling member.

4. The garment of claim 1, wherein the base opening is defined between the pair of base sides;

the first sleeve opening is defined between the pair of first sleeve sides;

the second sleeve opening is defined between the pair of second sleeve sides; and the body opening is defined between the pair of body sides.

5. The garment of claim 1, wherein the first sleeve member and the second sleeve member have a substantially same shape to each other.

6. The garment of claim 1, wherein at least one of the base coupling member, the first sleeve coupling member, the second coupling member, and at least one body coupling member includes at least one of a zipper, a button, a velcro tape, a magnet, a hook, and snap fasteners.

7. The garment of claim 1, wherein the base member, the first sleeve member, the second sleeve member, and the at least one body member define at least one of a pyramid shape, cone shape, and cuboid shape.

8. The garment of claim 1, wherein the at least one body member includes a hood member and a first body member, the hood member comprising, a pair of hood sides, a hood opening, and a hood coupling member on the periphery of the hood member, wherein the hood coupling member is configured to be attachably and detachably coupled to at least one of the first sleeve member, the second sleeve member, and the first body member, and wherein the base member, the first sleeve member, the second sleeve member, the first body member, and the hood member are attachably and detachably coupled to one another so as to define the bag.

9. The garment of claim 1, wherein the first sleeve member, the second sleeve member, and the at least one body member have the same shape and size to one another.

10. The garment of claim 9, wherein the first sleeve member, the second sleeve member, and the at least one body member have a triangular shape.

11. The garment of claim 1, wherein further comprises at least one strap member, wherein the at least one strap member comprises a hand strap, a first shoulder strap, and a second shoulder strap.

12. The garment of claim 1, wherein the base member, the first sleeve member, the second sleeve member, and the body member define a closed space.

13. The garment of claim 1, wherein the bag is a backpack or a tote bag.

14. A garment convertible to a bag comprising, a base member;

a first sleeve member extending horizontally from the base member;

a second sleeve member extending horizontally from the base member;

at least one body member extending vertically from the base member;

at least one strap member;

wherein the base member comprises:

a front base side, a rear base side, a base opening, and a base coupling member on the periphery of the base member;

the first sleeve member comprises:

a first front sleeve side, a first rear sleeve side, a first sleeve opening, and a first sleeve coupling member on the periphery of the first sleeve;

the second sleeve member comprises:

a second front sleeve side, a second rear sleeve side, a second sleeve opening, and a second sleeve coupling member on the periphery of the second sleeve;

the at least one body member comprises:

a front body side, a rear body side, a body opening, and at least one body coupling member on the periphery of the body member;

the at least one strap member comprises:

a hand strap, a first shoulder strap, and a second shoulder strap;

wherein the first shoulder strap is directly attached and vertically extending from a center of the first rear sleeve side, and the second shoulder strap is directly attached and vertically extending from a center of the second rear sleeve side, wherein a bottom edge of the hand strap is horizontally co-planar with a bottom edge of the first shoulder strap and a bottom edge of the second shoulder strap, wherein at least one of the base member, the first sleeve member, the second sleeve member, and the at least one body member is configured to be attachably and detachably coupled to at least another of the base member, the first sleeve member, the second sleeve member, and the at least one body member to define the bag, and wherein each and every one of the base member, the first sleeve member, the second sleeve member, and at least one body member constitutes at least a part of an exterior surface of the bag.

15. The garment of claim 11, wherein a transverse length and a longitudinal length of the first shoulder strap are equal to a transverse length and a longitudinal length of the second shoulder strap respectively.

16. The garment of claim 14, wherein a horizontal length and a vertical length of the first shoulder strap are equal to a horizontal length and a vertical length of the second shoulder strap respectively.

* * * * *